US006886826B2

(12) United States Patent
Leu

(10) Patent No.: US 6,886,826 B2
(45) Date of Patent: May 3, 2005

(54) APPARATUS AND METHOD FOR DESTACKING A STACK OF FLAT ARTICLES

(75) Inventor: Willy Leu, Pfäffikon (CH)

(73) Assignee: Ferag AG, Hinwil (CH)

( * ) Notice: Subject to any disclaimer, the term of this patent is extended or adjusted under 35 U.S.C. 154(b) by 1 day.

(21) Appl. No.: 10/641,384

(22) Filed: Aug. 14, 2003

(65) Prior Publication Data

US 2004/0032075 A1 Feb. 19, 2004

Related U.S. Application Data

(63) Continuation of application No. PCT/CH01/00719, filed on Dec. 17, 2001.

(30) Foreign Application Priority Data

Feb. 15, 2001 (CH) ..... 0265/01

(51) Int. Cl.[7] ..... B65H 5/00

(52) U.S. Cl. ..... 271/10.14; 271/264; 271/204; 271/42; 271/128; 271/157

(58) Field of Search ..... 271/10.01, 10.14, 271/11, 10.04, 10.06, 10.08, 10.16, 264, 204, 157, 42, 128

(56) References Cited

U.S. PATENT DOCUMENTS

| | | | | | |
|---|---|---|---|---|---|
| 1,009,289 | A | * | 11/1911 | Duffy | 271/42 |
| 3,645,527 | A | * | 2/1972 | Gates | 271/42 |
| 3,776,544 | A | | 12/1973 | Watson et al. | |
| 3,887,178 | A | | 6/1975 | Fujimoto | |
| 4,033,577 | A | * | 7/1977 | Godard et al. | 271/128 |
| 4,148,473 | A | * | 4/1979 | Johnson | 271/20 |
| 4,290,593 | A | * | 9/1981 | Irvine | 271/42 |
| 4,333,559 | A | * | 6/1982 | Reist | 198/461.3 |
| 4,444,383 | A | * | 4/1984 | Crislip et al. | 271/14 |
| 4,566,687 | A | * | 1/1986 | Faltin | 271/202 |
| 4,618,054 | A | * | 10/1986 | Muller | 198/409 |
| 4,905,818 | A | * | 3/1990 | Houseman | 198/803.7 |
| 4,953,847 | A | * | 9/1990 | Honegger | 271/277 |
| 5,465,952 | A | * | 11/1995 | Eberle et al. | 271/204 |
| 5,494,273 | A | * | 2/1996 | Hansch | 271/9.02 |
| 5,542,656 | A | * | 8/1996 | Stauber | 271/11 |

(Continued)

FOREIGN PATENT DOCUMENTS

| | | | | |
|---|---|---|---|---|
| CH | 436349 | | 5/1967 | |
| JP | 01008140 A | * | 1/1989 | B65H/3/08 |
| JP | 01022739 A | * | 1/1989 | B65H/3/08 |
| JP | 01104534 A | * | 4/1989 | B65H/3/08 |
| JP | 01226663 A | * | 9/1989 | B65H/31/30 |
| JP | 03259832 A | * | 11/1991 | B65H/3/08 |
| JP | 03293240 A | * | 12/1991 | B65H/3/52 |
| JP | 04007225 A | * | 1/1992 | B65H/3/08 |
| WO | WO 99 33731 | | 7/1999 | |
| WO | WO 99 33734 A | | 7/1999 | |

OTHER PUBLICATIONS

Copy of International Search Report for PCT/CH01/00719 completed Apr. 15, 2002.

*Primary Examiner*—Donald P. Walsh
*Assistant Examiner*—Matthew J. Kohner
(74) *Attorney, Agent, or Firm*—Alston & Bird LLP

(57) ABSTRACT

An apparatus and method for destacking a stack of flat sheet-like articles, comprising a bearing surface for supporting the stack at a fixed elevation, and a separating arrangement for repeatedly separating the uppermost article from the stack and transferring it laterally onto a removal conveyor. The separating arrangement is mounted for vertical movement so as to float downwardly as the height of the stack decreases, and the separating arrangement can be lifted upwardly at the conclusion of the destacking operation so that a further stack can be fed onto the bearing surface along a lateral feed plane which includes the bearing surface.

8 Claims, 3 Drawing Sheets

U.S. PATENT DOCUMENTS 5,669,604 A * 9/1997 Hansen ..... 271/265.01
5,941,518 A 8/1999 Sokac et al.
6,142,462 A * 11/2000 Moser et al. ..... 271/157
6,394,449 B1 * 5/2002 Reist ..... 271/204
6,595,740 B1 * 7/2003 Drake et al. ..... 414/796.8
6,682,064 B2 1/2004 Leu et al.
6,729,237 B2 * 5/2004 Kawamura et al. ..... 101/477
2001/0054788 A1 12/2001 Leu
2002/0109284 A1 8/2002 Leu et al.

* cited by examiner

APPARATUS AND METHOD FOR DESTACKING A STACK OF FLAT ARTICLES

CROSS REFERENCE TO RELATED APPLICATION

This is a continuation of international application PCT/CH01/00719 filed Dec. 17, 2001 and designating the U.S. The disclosure of the referenced application is expressly incorporated herein by reference.

BACKGROUND OF THE INVENTION

The invention relates to an apparatus for, and a method of, destacking a stack of flat articles, of the general type disclosed in WO 00/46135 and corresponding U.S. Pub. No. 2001/0054788. As there disclosed, a stack of flat articles, in particular printed products, rests on a bearing surface and is destacked from above by a separating arrangement. The separating arrangement is supported on the stack from above by means of a load bearing structure, with the result that its vertical distance from the stack is always constant during destacking.

The separating arrangement as disclosed in the above documents is used to separate out individual articles from the stack and to transfer them to a removal arrangement in the form of a belt conveyor. The separating arrangement comprises a sucker by means of which the article which is located at the top of the stack in each case is attached by suction at one end. A pusher then grips beneath the article and pushes it out of the stack in the direction of the removal arrangement. By virtue of articles being periodically separated out, an imbricated stream of partially overlapping articles is produced on the belt conveyor. The removal arrangement can be pivoted in the manner of a rocker, with the result that it is possible for the height of the region in which articles can be received to be adapted to the current stack height and for the articles to be pushed onto the belt conveyor essentially in their own plane. The removal arrangement is connected to the separating arrangement via the load-bearing structure, with the result that the height adaptation likewise takes place passively by sensing of the current stack height.

The above referenced documents propose that, during destacking or once destacking has taken place, a further stack of flat articles is fed to the region of the bearing means from beneath, i.e. in the normal direction to the bearing surface. The further stack here is located on a further bearing means, which is oriented parallel to the first-mentioned bearing means and is moved in the normal direction thereto. In order to ensure a continuous changeover from one stack to the next and thus a gap-free imbricated stream, it is necessary for the bearing means located between the two stacks to be removed in a suitable manner. As an alternative, the above documents propose using individual products in an imbricated stream in a plane which runs parallel to the bearing surface of the stack, but is located therebeneath. It is also the case with this variant that the bearing surface between the two sub-stacks has to be removed at a given time. This can only be realized with high design related outlay.

DE 1947095 B2 and U.S. Pat. No. 3,776,544 disclose an apparatus which is intended for discharging flat articles and in the case of which individual stacks are supplied on a conveying belt and removed from beneath. For this purpose, the stack, in the destacking position, is tilted by a barrier which is inclined in the vertical, and the respectively lowermost article of the stack is drawn out of the stack by a belt conveyor, while the articles located thereabove are retained by the barrier. The problem here is that the weight of the entire stack always bears on the article which is to be removed, the latter thus being subjected to mechanical stressing during removal.

The object of the invention is thus to provide an apparatus for, and a method of, destacking a stack of flat articles in the case of which the destacking follows from above in a manner which does not adversely affect the articles, and the operation of feeding the stack is simplified in relation to the known apparatuses.

SUMMARY OF THE INVENTION

The above and other objects and advantages of the invention are achieved by the provision of a destacking apparatus which has a bearing surface for supporting a vertical stack of the articles, and a separating arrangement mounted for vertical movement so that its vertical distance from the uppermost article on the stack is essentially constant during destacking. The separating arrangement is configured for repeatedly separating out at least the uppermost article from the stack and transferring it to a removal arrangement.

A lifting mechanism is provided for lifting the separating arrangement to a predetermined height, once destacking has taken place. A further stack which is to be destacked can be introduced into the resulting gap between the bearing surface and the separating arrangement by being fed along a feed plane which is defined by the bearing surface. There is thus no need for any complicating lifting mechanism for the stack itself. The operation of feeding a new stack can be realized by straightforward means, for example a belt conveyor. Thus in accordance with the invention, the changeover from one stack to the next is possible in an extremely straightforward manner.

The invention dispenses with the gap-free discharge of articles to a removal arrangement during the changeover between two stacks, with the result that it is possible for gaps to be produced in the product stream which is to be removed. The invention is thus used particularly advantageously in conjunction with a removal arrangement in the case of which the articles are moved by individually moveable conveying means, with the result that it is possible to change the distances between two articles during removal and to compensate again for gaps in the product stream, if required.

The apparatus preferably comprises a removal arrangement which is coupled mechanically to the separating arrangement and can be height adjusted together with the latter.

Various possibilities are known for the purpose of separating out the uppermost article from the stack. The separating arrangement can attach the uppermost article by suction, using negative pressure, and, finally, separate it out using a pusher, as described, for example, in WO 00/46135 and U.S. Publ. No. 2001/0054788, the disclosures of which are incorporated herein by reference. Furthermore, it is possible to use, for example, a suitably configured separating element to rotate the uppermost article out of the stack, in its own plane, with a force or friction fit, as described, for example, in CH 436349. In a further development of the principle known from CH 436349, the separating element can be used to push a corner of the uppermost article against a stop, the uppermost article sliding laterally past the latter as a result of bending, while articles located beneath it are stopped. A corresponding separating mechanism is described by the same applicant in U.S. Pat. No. 6,682,064.

As a removal arrangement, it is possible to use a belt conveyor which is configured so that the height at which it is capable of receiving articles is variable. For example, use is made of the design described in WO 00/46135. In this case, the separating arrangement is coupled mechanically to the belt conveyor, which is designed as a rocker, by means of a load-bearing structure, with the result that the height of the separating arrangement and of the removal conveyor are adapted passively to the height of the stack which is to be destacked. A further possible removal arrangement is a gripper conveyor as described, for example, in WO 99/33731 or WO 99/33734. The removal arrangement preferably has a plurality of grippers which can be moved individually along a rail by conveying means. The position in which the grippers close is preferably adapted to the current height of the stack which is to be destacked.

BRIEF DESCRIPTION OF THE DRAWINGS

Exemplary embodiments of the invention are described hereinbelow and illustrated in the drawing, in which, purely schematically.

DETAILED DESCRIPTION OF THE PREFERRED EMBODIMENTS

Figure 1A:
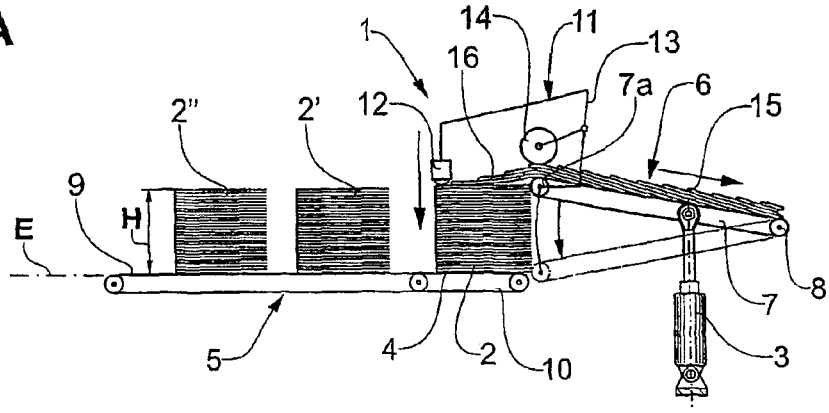
FIGS. 1A–D show a side view of an apparatus according to the invention at a number of different points in time as the method according to the invention is implemented.

FIGS. 1A–D show a destacking apparatus 1 in a number of stages as the destacking method is implemented. A first stack 2 is located in the destacking position on a bearing surface 4. The individual sheet-like articles 16 here are oriented with their surface parallel to the bearing surface 4. The bearing surface 4 is formed by the conveying belt of a belt conveyor 10. Further stacks 2', 2" are located on a further belt conveyor 9, which is located in a common plane, the feed plane E, with the first-mentioned belt conveyor 10. The two belt conveyors 9, 10 convey in the same direction and form a feed arrangement 5, by means of which stacks 2, 2', 2" which are to be destacked are fed to the destacking apparatus 1. Prior to destacking, the stacks 2, 2', 2" have a maximum height H. It is also possible for the heights of the individual stacks 2, 2', 2" to be different.

The stack 2 located on the bearing surface 4 is destacked by means of a separating arrangement 11, a separating element 12 pushing the respectively uppermost article beyond the outline of the stack and thus transferring it to a removal arrangement 6. The separating element 12 is, for example, a roller with a surface which has a good grip. This rests on the stack 2 and thus removes the uppermost article in each case from the stack 2. The separating element 12 is connected rigidly, at least in the vertical direction, to the removal arrangement 6 via a load-bearing structure 13. The removal arrangement 6 is thus also always retained at a height which is adapted to the current stack height.

The removal arrangement 6 comprises a belt conveyor 7 which can be pivoted in the manner of a rocker about an axis 8 running transversely to the removal direction. The belt conveyor 7 is always moved, via the load-bearing structure 13 and the separating element 12, also serving for height-sensing purposes, such that its end 7*a,* which is directed toward the stack 2 which is to be destacked, is located approximately at the height of the uppermost article. The separating mechanism 11 further comprises a transporting roller 14, which is likewise arranged on the load-bearing structure 13 and conveys the articles further on the removal conveyor with a force or friction fit or by gripping behind the trailing edges thereof.

According to the invention, the destacking apparatus 1 includes a lifting arrangement 3, by means of which the height of the separating arrangement 11 above the bearing surface 4 can be changed actively, i.e. irrespective of the stack which is to be destacked.

Figure 1B:
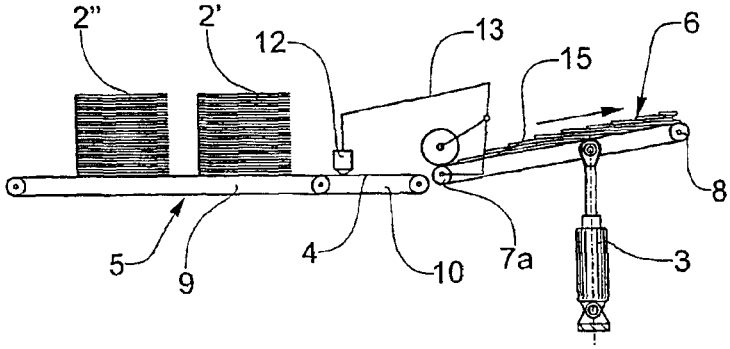
Figure 1C:
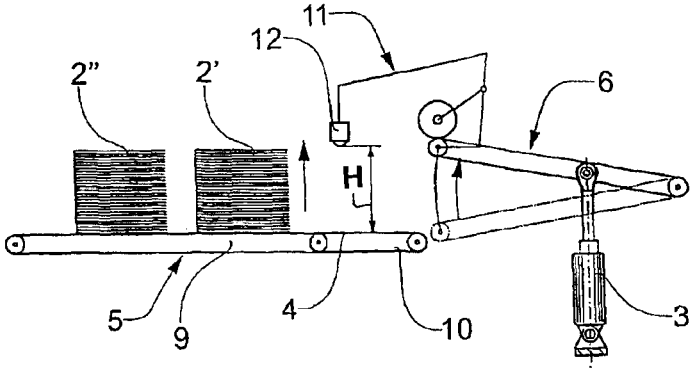
Figure 1D:
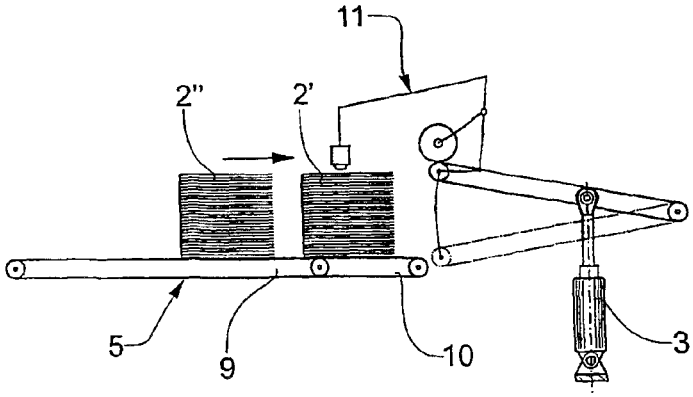

The situation at the beginning of the operation of destacking a stack 2 is illustrated in FIG. 1A. The end 7*a* of the removal arrangement 6, said end being directed toward the stack 2, is located at the height H of the stack 2 which is to be destacked. Dashed lines illustrate the position of the removal conveyor 6 when the stack has been fully destacked. FIG. 1B shows the situation with the stack fully destacked and the bearing surface 4 empty. The separating element 12, which also serves for height-monitoring purposes, in this case rests on the bearing surface 4. Via the load-bearing structure 13, the removal arrangement 6 is also positioned such that its front end 7*a* is located approximately at the height of the bearing surface 4.

Once destacking has taken place, the separating arrangement 11 and removal arrangement 6 is displaced upward by means of the lifting arrangement 3, with the result that a gap equal to the height H for receiving a further stack 2' is produced between the separating element 12 and the bearing surface 4. The feed arrangement 5 is moved in order to displace a further stack 2' into the destacking position on the bearing surface 4. The separating arrangement 11 can then be lowered again onto the stack. A new destacking cycle can begin. The lifting arrangement 3 is deactivated, with the result that the position of the separating arrangement 11 and of the removal arrangement 6 is adapted automatically to the height of the stack 2' which is now to be destacked.

The operations of feeding stack 2, 2', 2" and removing individual articles 16 in the form of an imbricated stream 15 take place here essentially in the same direction in the drawing plane. It is also possible, however, for the feed and removal operation to take place in different directions. It is also possible for pushing means to push the stacks 2, 2', 2" into the destacking position.

Figure 2:
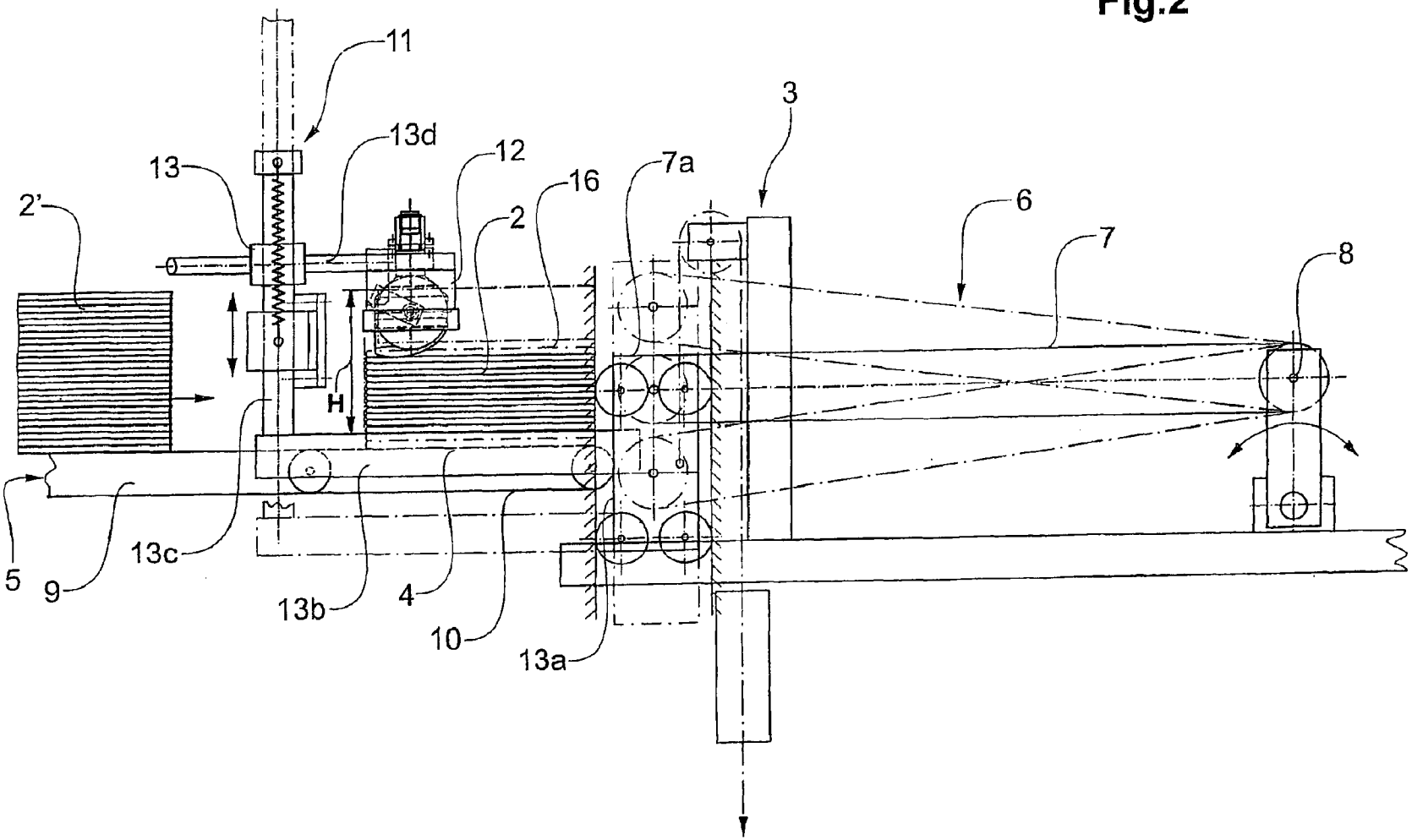
FIG. 2 shows a side view of an apparatus according to the invention with a pivotably mounted removal conveyor designed as a belt conveyor.

FIG. 2 shows a further view of an apparatus according to the invention for destacking stacks 2, 2'. As has already been described, stacks 2, 2' are brought into the destacking position on the bearing surface 4 by a feed arrangement 5, comprising two belt conveyors 9, 10 arranged one behind the other. The separating mechanism 11 is connected rigidly to the front end 7*a* of the removal arrangement 6 via a load-bearing structure 13, comprising individual structural elements 13*a*, 13*b*, 13*c*, 13*d*. All the elements of the load-bearing structure 13 are arranged to the sides of, or above, the feed arrangement 5, with the result that they do not obstruct the stacks fed. The separating arrangement 11 and the removal arrangement 6 are described in specific terms in WO 00/46135 and U.S. Publ. No. 2001/0054788. To supplement this, the apparatus according to FIG. 2 has a lifting arrangement 3, by means of which the separating element 12 can be displaced to a predetermined height H irrespective of the height of the stack 2 which is to be destacked.

Figure 3A:
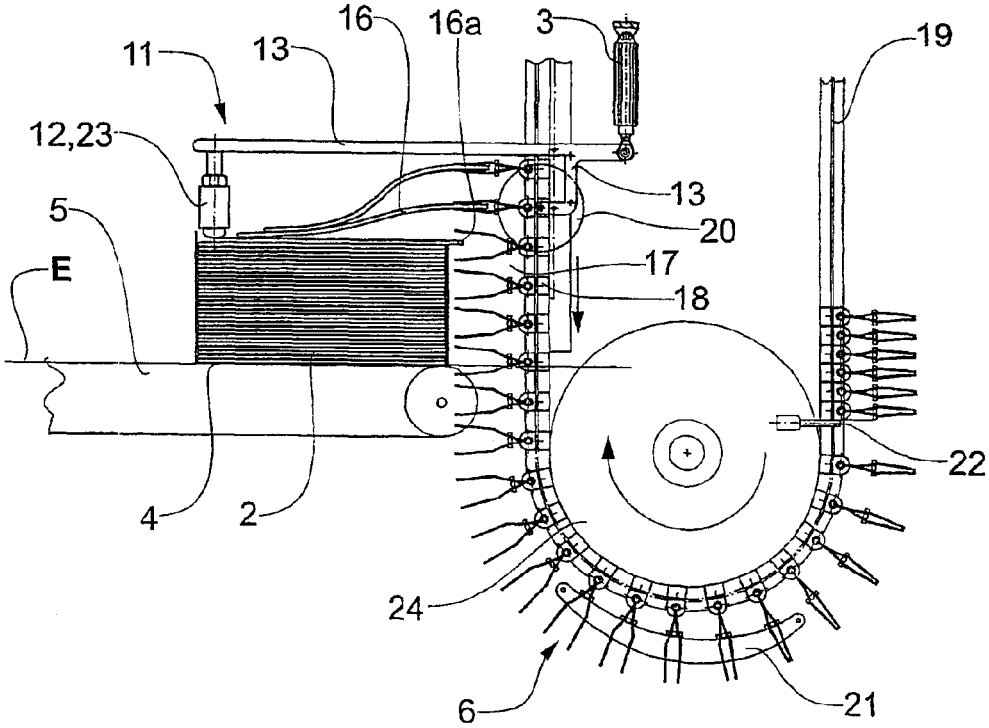
FIGS. 3A, B show a side view of an apparatus according to the invention with the removal conveyor designed as a gripper conveyor.
Figure 3B:
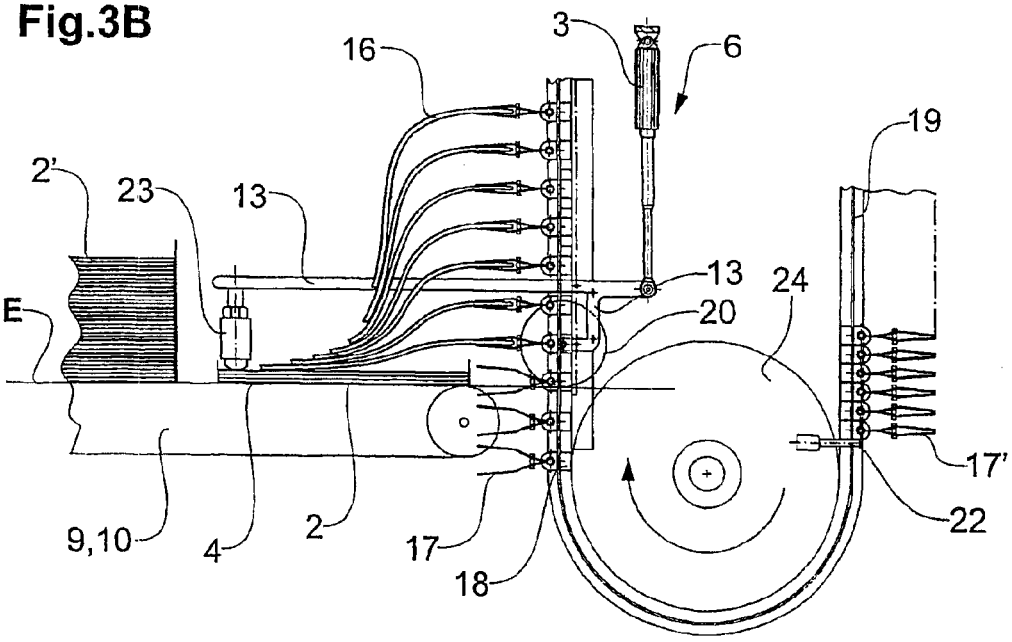

FIGS. 3A and 3B show a further apparatus according to the invention, this time with a gripper conveyor as removal arrangement 6. A feed arrangement 5 brings a stack 2 into the destacking position on a bearing surface 4, which in this case is formed by an end region of the belt conveyor. By means of a separating arrangement 11, the uppermost articles 16 in each case are pushed laterally out of the stack 2. They are gripped by grippers 17 at their ends 16*a* projecting out of the stack. The grippers are fastened on conveying means 18 which are moved along a rail 19. The conveying means 18 can be moved individually. In the present case, in each case a certain number of conveying means 18 is guided past the stack 2 which is to be destacked. These each receive an article until the stack 2 has been destacked. In the situation according to FIG. 3B, in which there are still three articles present in the stack 2, a further three empty grippers 17 approach the transfer region, while further grippers 17' are stopped by means of a blocking element 22.

These further grippers 17' are only released when the further stack 2' has advanced into the destacking position and destacking of articles is continued. Since the conveying means 18 can be moved individually along the rails 19, it is possible to compensate again for the resulting gap into the product stream. There is no need, however, for stacks to be destacked without interruption.

The separating arrangement 11 is connected to a closing guide 20 via a load-bearing structure 13. The closing guide 20 serves for closing the grippers 17. It is arranged such that closure takes place a little way above the plane defined by the uppermost article in the stack. The height conditions described are realized by the separating element 12 or a pressure-exerting element 23, which serves for sensing the height of the stack 2. A lifting mechanism 3 can be used to bring the separating arrangement 11 and the closing guide 20 to a predetermined height again once destacking has taken place.

The grippers 17, 17' are transported in a closed state and are only opened in the vicinity of the transfer region, by means of an opening guide 21. The conveying means 18 are moved along the rail 19 by means of a drive 24.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for destacking a stack of flat sheet-like articles, comprising a bearing surface for supporting a vertical stack of the articles, a separating arrangement mounted for vertical movement and so that its vertical distance from the uppermost article of the stack is essentially constant during destacking, and with said separating arrangement being configured for repeatedly separating out at least the uppermost article from the stack and transferring it to a removal arrangement, a lifting mechanism for lifting the separating arrangement to a predetermined height above the bearing surface once the destacking of the stack has taken place, and a feed arrangement for feeding a further stack of articles which is to be destacked to the bearing surface, while the lifting mechanism supports the separating arrangement at said predetermined height, and including feeding the further stack which is to be destacked along a feed plane which includes the bearing surface, wherein the removal arrangement includes a transfer region which receives the articles from the separating arrangement, with the transfer region being vertically adjustable and coupled to the separating arrangement so that the height of the transfer region is adapted to the current height of the stack, wherein the removal arrangement comprises a plurality of grippers which are configured for receiving individual articles, with said grippers being individually moveable along a movement path, and wherein the removal arrangement further comprises a closing guide for the grippers which is connected to the separating arrangement so as to be positioned adjacent the transfer region, with the result that the height at which the grippers are closed is adapted to the current stack height.

2. The apparatus of claim 1 wherein the feed arrangement comprises a belt conveyor of which the upper conveying belt is located in the feed plane.

3. The apparatus of claim 2 wherein the upper conveying belt forms the bearing surface.

4. The apparatus of claim 1 wherein the separating arrangement is mounted such that it is supported on the stack during destacking.

5. The apparatus of claim 1 wherein the separating arrangement is configured for moving the uppermost article of the stack in a plane defined by the uppermost article.

6. The apparatus of claim 5 wherein the separating arrangement includes a pressure exerting element which rests on the stack, and a separating element which is connected to the pressure exerting element and can be moved parallel to the bearing surface and is configured to move the uppermost article for transfer to the removal arrangement.

7. The apparatus of claim 1 wherein the separating arrangement and the lifting mechanism are configured such that the separating arrangement floats on the stack during destacking.

8. A method of destacking a stack of flat sheet-like articles which rest on a bearing surface, comprising the steps of repeatedly separating the uppermost article from the stack and transferring it to a removal arrangement which comprises a plurality of grippers by contacting the uppermost article with a separating arrangement, causing the separating arrangement to move downwardly as the stack is destacked so that the vertical distance of the separating arrangement from the uppermost article is essentially constant, lifting the separating arrangement to a predetermined height above the bearing surface upon destacking of the stack being at least substantially completed, and then feeding a further stack to be destacked onto the bearing surface by movement along a feed plane which includes the bearing surface, and repeating the above steps, and wherein the step of transferring the uppermost article to the removal arrangement comprises gripping the article by one of said grippers at a height which is adapted to a current stack height, closing the gripper on the gripped article by a closing guide which is connected to the separating mechanism, and moving the closed gripper and the gripped article along a movement path.

* * * * *